US007611398B2

(12) United States Patent
Woodhouse

(10) Patent No.: US 7,611,398 B2
(45) Date of Patent: Nov. 3, 2009

(54) TOY SWORD

(75) Inventor: Hampton Woodhouse, Hope, RI (US)

(73) Assignee: Hasbro, Inc., Pawtucket, RI (US)

( * ) Notice: Subject to any disclaimer, the term of this patent is extended or adjusted under 35 U.S.C. 154(b) by 235 days.

(21) Appl. No.: 11/383,531

(22) Filed: May 16, 2006

(65) Prior Publication Data

US 2007/0270077 A1 Nov. 22, 2007

(51) Int. Cl.
*A63H 33/22* (2006.01)
*A63H 33/26* (2006.01)

(52) U.S. Cl. ..... 446/473; 446/485

(58) Field of Classification Search ..... 446/473, 446/485

See application file for complete search history.

(56) References Cited

U.S. PATENT DOCUMENTS 3,037,320 A * 6/1962 Powell ..... 446/473
4,678,450 A 7/1987 Scolari et al.
4,697,228 A 9/1987 Mui et al.
5,145,446 A 9/1992 Kuo
5,149,092 A * 9/1992 Parsons ..... 463/47.7
5,287,255 A * 2/1994 Strodtman ..... 362/102
5,919,079 A * 7/1999 Coleman et al. ..... 446/487
5,947,789 A 9/1999 Chan
6,238,292 B1 * 5/2001 Pelkey ..... 463/47.7
6,641,280 B2 11/2003 Hanson et al.

* cited by examiner

*Primary Examiner*—John Ricci
(74) *Attorney, Agent, or Firm*—Miller, Matthias & Hull

(57) ABSTRACT

A toy sword is disclosed which more accurately replicates the functionality and appearance of fictional light sabers. The sword uses a plurality of telescoping tubes which are fully retractable into the hilt of the sword, and a spring movable between extended and active positions. The spring works in conjunction with a projectile which upon release launches with a smallest diameter tube of the plurality of telescoping tubes and advances same distally away from the hilt. The tubes are telescopingly manufactured so that as the smallest diameter tube reaches the end of its travel, it frictionally engages a distal end of the next smallest diameter tube and in so doing carries that tube distally. In so doing, the entire plurality of tubes is outwardly launched in a cascading fashion. When manually depressed back into the hilt, each of the telescoping tubes is entirely retracted into the hilt, thus not being visible to the user in the retracted position.

20 Claims, 4 Drawing Sheets

TOY SWORD

FIELD OF THE DISCLOSURE

The disclosure generally relates to toys and, more particularly, relates to toy swords and light sabers.

BACKGROUND OF THE DISCLOSURE

Sword play has long been a favorite of children, particularly boys. Mimicing the actual sword fighting of knights, such toys allow children to practice the thrusts and parties of actual duels, while having safe fun pretending. Such toys can be based on conventional swords having a hilt or handle from which a long blade extends. With such toys, they are typically manufactured from plastic or other dull and flexible materials to allow for the play to be both fun and safe.

Certain recent movies have also generated interest in not just conventional swords but light sabers as well. For example, the Star Wars® movies have generated extreme interest in this regard. As one of ordinary skill in the art will readily understand, such swords are not conventional but rather have a handle or hilt from which a laser beam supposedly extends. Toys which have attempted to mimic this form of light saber have of course not used actual lasers but rather mechanical structures which mimic such a blade. One example is Scolari, U.S. Pat. No. 4,678,450. With such a sword, a fixed blade extends from a handle in which is provided a battery and a strobe lamp. Activation of the strobe lamp causes the blade, which is translucent, to light While such a toy mimics the "light" component of such sabers, it remains a fixed length blade. Fans of such movies understand, however, that when light sabers are de-activated the light forming the blade completely dissipates. Other toys have accordingly been created that attempt to retract the blade into the hilt. One example of this type of toy is Kuo, U.S. Pat. No. 5,145,446. With such a toy, the blade is provided in the form of at least two telescoping tubes with springs provided therein. The springs bias the telescoping tubes into an extended position. However, the blades are not fully retractable into the handle or hilt, but rather at least one of the tubes forming the blade is always extended therefrom. In addition, a relatively complex motor, pulley and cable arrangement is provided to retract the blades into the handle, and individual springs are provided in each tube of the blade.

Accordingly, it can be seen that a need exists for a toy light saber which more accurately replicates that depicted in the movies, while improving the ease with which the saber can be moved between extended and retracted positions as well.

SUMMARY OF THE DISCLOSURE

In accordance with one aspect of the disclosure, a toy sword is disclosed which comprises a hilt and a plurality of telescoping tubes. The plurality of telescoping tubes are mounted to the hilt and are movable between active and stowed positions. Each of the plurality of telescoping tubes is fully retracted into the hilt when in the retracted position, and each of the plurality of tubes is extended from the hilt when in the active position.

In accordance with another aspect of the disclosure, a toy sword is disclosed which comprises a hilt, a plurality of telescoping tubes, and a spring. The telescoping tubes are mounted to the hilt and are movable between stowed and active positions. The spring is provided entirely within the hilt and is movable between a compressed state wherein the plurality of telescoping tubes are in the stowed position, and a released state wherein the plurality of tubes are in the active position.

In accordance with another aspect of the disclosure, a toy sword is disclosed which comprises a hilt, a plurality of telescoping tubes, a spring, a latch, and a projectile. The plurality of telescoping tubes are mounted to the hilt and are movable between stowed and active positions. The spring is movable between compressed and released positions and drives the plurality of telescoping tubes from the stowed to the active position when released from the compressed state to the released state. The latch releasably holds the spring in the compressed state and includes a hook end and a latch end. The latch end is pivotally mounted to the hilt between the hook end and the latch end. The projectile includes a shoulder and a head with the head being engagable with the plurality of telescoping tubes against the spring in the compressed state. The latch hook end engages the projectile shoulder when the spring is in the compressed state.

These and other aspects and features of the disclosure will become more apparent upon reading the following detailed description when taken in conjunction with the accompanying drawings.

Figure 1:
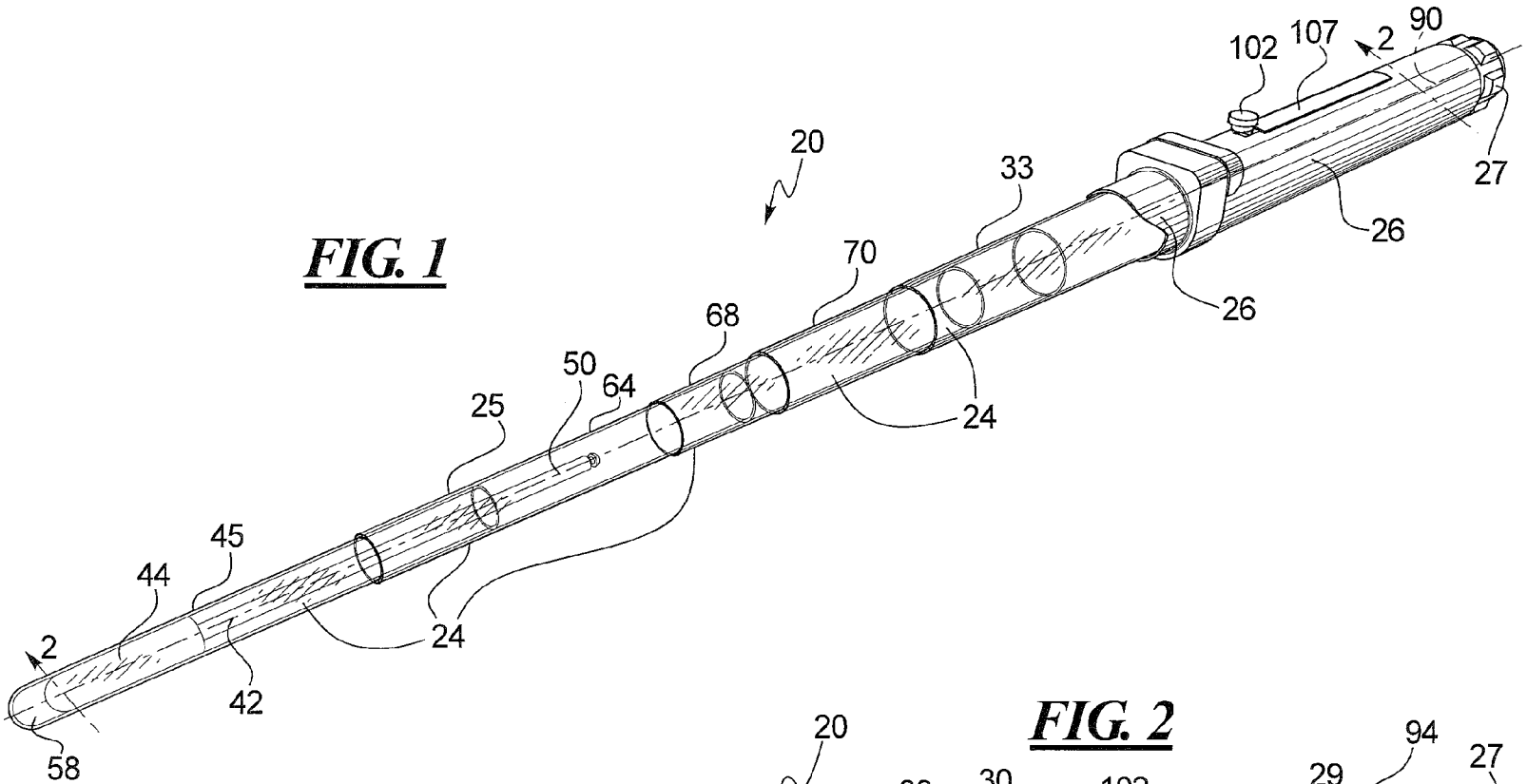
FIG. 1 is a perspective view of a toy sword constructed in accordance with the teachings of the disclosure and depicted in an extended position.

While the present disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and equivalents falling within the spirit and scope of the disclosure as defined by the appended claims.

DETAILED DESCRIPTION OF THE DISCLOSURE

Referring now to the drawings and with specific reference to FIG. 1, a toy sword constructed in accordance with the teachings of the disclosure is generally referred to by reference numeral 20. While the toy will be referred to herein as a "sword", it is to be understood that "sword" encompasses, among other things, sabers, light saber's, and the like such as those marketed under the Star Wars® trademark. In addition, as used herein "distal" or "distal end" refer to the tip of the blade, or in the direction of the tip of the blade, while "proximal" or "proximal end" refer to the base of the hilt, or in the direction of the base of the hilt.

Figure 3:
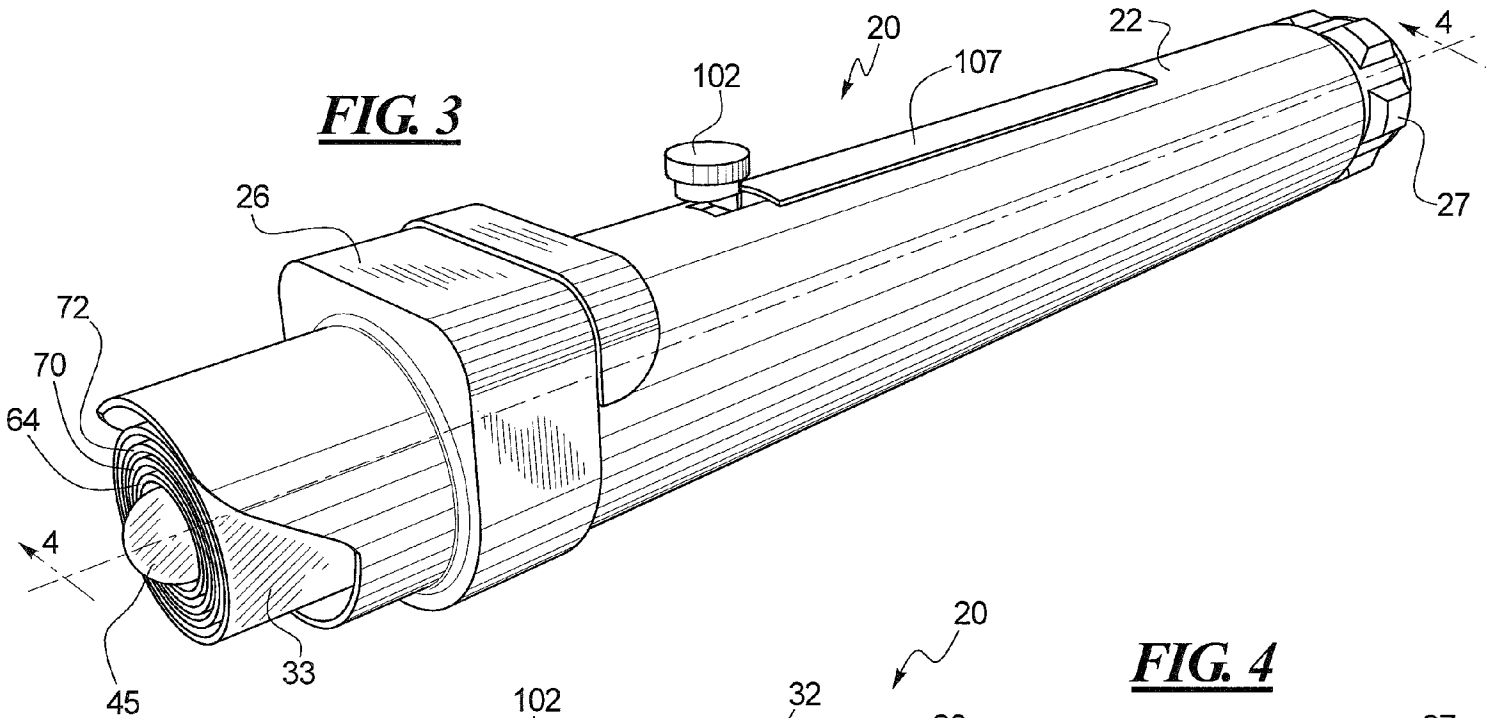
FIG. 3 is a perspective view of the toy sword but depicted in a retracted or stowed position.

As shown therein, the sword 20 includes a hilt 22 or handle from which a plurality of telescoping tubes 24 are adapted to extend to form a blade 25. As shown in a comparison between FIG. 1 and FIG. 3, the plurality of telescoping tubes 24 are both fully extendable from the hilt 22 as shown in FIG. 1, and fully retractable into the hilt 22 as shown in FIG. 3. In so doing, such a toy mote accurately replicates the light saber depicted in the Star Wars® series of movies. Each of the plurality of telescoping tubes is frusto-conical in shape, and each has a slightly different diameter to aid with telescoping retraction and extension as described in greater detail herein. While the hilt 22 and blade 25 are shown having one appearance in the drawings, it is to be understood that the teachings of the disclosure can be employed with any aesthetic design for a toy sword or other device. The hilt 22 in particular could be manufactured in any number of different shapes and sizes to match different designs used in the story. For example, in the depicted embodiment, decorative endcaps 26 and 27 are provided but need not be included.

Figure 2:
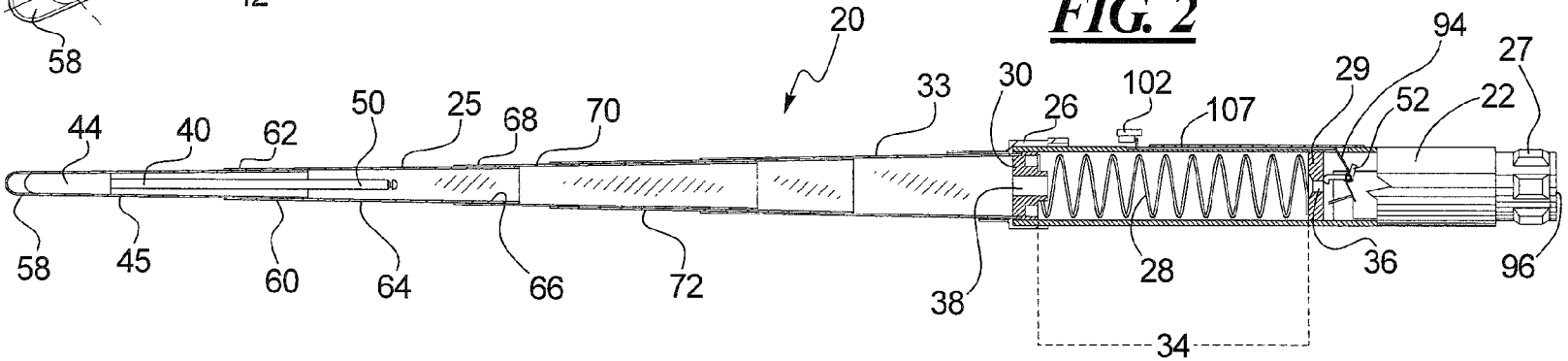
FIG. 2 is a longitudinal sectional view of the sword of FIG. 1 taken along line 2-2.
Figure 4:
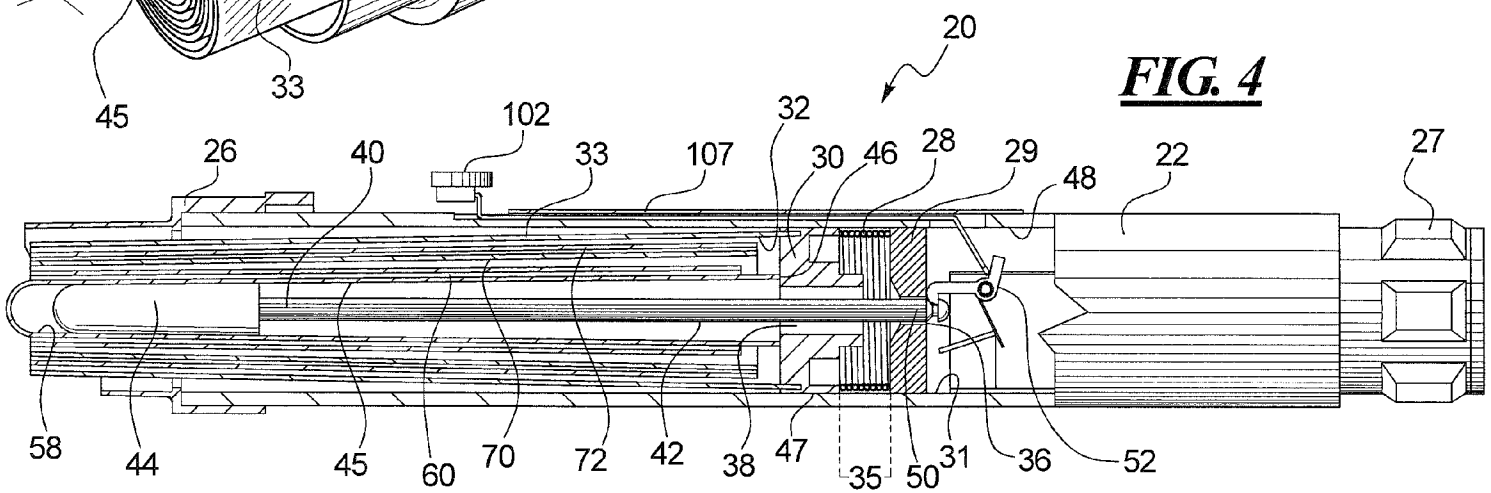
FIG. 4 is a longitudinal sectional view of the sword of FIG. 3 taken along line 4-4.

In order to show the manner in which the plurality of telescoping tubes 24 are extendable from the hilt 22, reference is made to FIGS. 2 and 4, which are longitudinal sectional views of FIGS. 1 and 3, respectively. As shown therein, the sword 20 further includes within the hilt 22, a spring 28 entirely held within the cylindrical hilt 22 between a back stop 29 and a launching plate 30. The back stop 29 is fixed to an inner surface 31 of the hilt 22, while the launching plate 30 is fixed to an end surface 32 of a largest diameter tube 33 of the plurality of tubes 24. When the spring 28 is in its released state it will be seen that the launching plate 30 and back stop 29 are separated by a distance 34 as shown in FIG. 2, and when in a compressed state, the back stop 29 and launching plate 30 are closer together and separated by a distance 35 as shown in FIG. 4.

The back stop 29 and launching plate 30 include apertures 36 and 38, respectively. These apertures 36 and 38 are provided to allow for passage of a projectile 40, more specifically, a stem or leg 42 of the projectile 40. The projectile 40 further includes a head 44 which functionally holds the projectile 40 within a smallest diameter tube 45 of the plurality of tubes 24. In the retracted or stowed position of the toy 20, as can be seen best from FIG. 4, the launching plate 30 is pushed by a rear edge 46 of the smallest diameter tube 45 into the hilt 22 until an outside surface 47 of the launching plate 30 frictionally engages an inner surface 48 of the hilt 22. Such movement causes the spring 28 to be fully compressed between the launching plate 30 and the back stop 29. In this position, the stem 42 extends through the aperture 38 of the launching plate 30, as well as through the aperture 36 of the back stop 29. A proximal end 50 of the stem 42 is then held by a latch 52 as will be described in further detail herein. Accordingly, in the compressed state, the latch 52 secures the proximal end 50 of the projectile 40 in the hilt, while holding the spring 28 in a compressed state as well.

When the latch 52 is released, however, the spring 28 moves from its compressed state to its released state shown in FIG. 2. In so doing, the launching plate 30 is rapidly advanced from the compressed position to the extended position. In addition, as the latch 52 no longer holds the proximal end 50 of the stem 42, the projectile 40 is launched distally away from the hilt 22 as well. After launching, the projectile 40 rapidly advances, and as the head 44 is held within a distal end 58 of a smallest diameter tube 45 of the plurality of tubes 24, so does the smallest diameter tube 45. As the smallest diameter tube 45 advances it moves until its proximal end 60 frictionally engages a distal end 62 of a second smallest diameter tube 64. Likewise, this second smallest diameter tube 64 is carried distally by the force of the advancing projectile 40 until its proximal end 66 frictionally engages a distal end 68 of a third smallest diameter tube 70. Such movement continues in cascading fashion both with a fourth smallest diameter tube 72, and the largest diameter tube 33.

It is important to note that while five separate tubes form the plurality of telescoping tubes 24 in the depicted embodiment, such technology and structure can be employed with any number of different tubes using more or less than those depicted in FIGS. 1-4. The tubes 24 and spring 28 simply need to be sized appropriately. Such structure works by providing the tubes 24 in telescoping fashion allowing for some distal movement until a diameter of the proximal end of one tube is sufficiently large so as to prevent any further distal movement within the next largest diameter tube. In so doing, the advancing projectile 40 causes each of the telescoping tubes 24 to distally advance from the hilt 22.

To further enhance the functionality of the toy 20, the head 44 of the projectile 40 is sized so as to be received frictionally into the extreme distal end 58 of the smallest diameter tube 45. The head 44 can be made from an elastomeric material so as to be easily gripped within the smallest diameter tube 45 when launched. Such elastomeric properties also may add to the acoustic deadening qualities of the toy and to secure the projection 40 into the smallest diameter tube 45 even after launching and reaching the extended state thus removing any potential for the projectile 40 to rattle within the toy after launch. The distal end 58 of the smallest diameter tube 45 can also be fully closed as shown for these purposes, as well as aesthetic purposes. The head 44 and/or stem 42 may also be weighted or made of relatively heavy materials so as to increase the momentum of the projectile 40 and smallest diameter tube 45 as they are launched, thus facilitating the expansion of the blade 25.

Figures 5, 7:
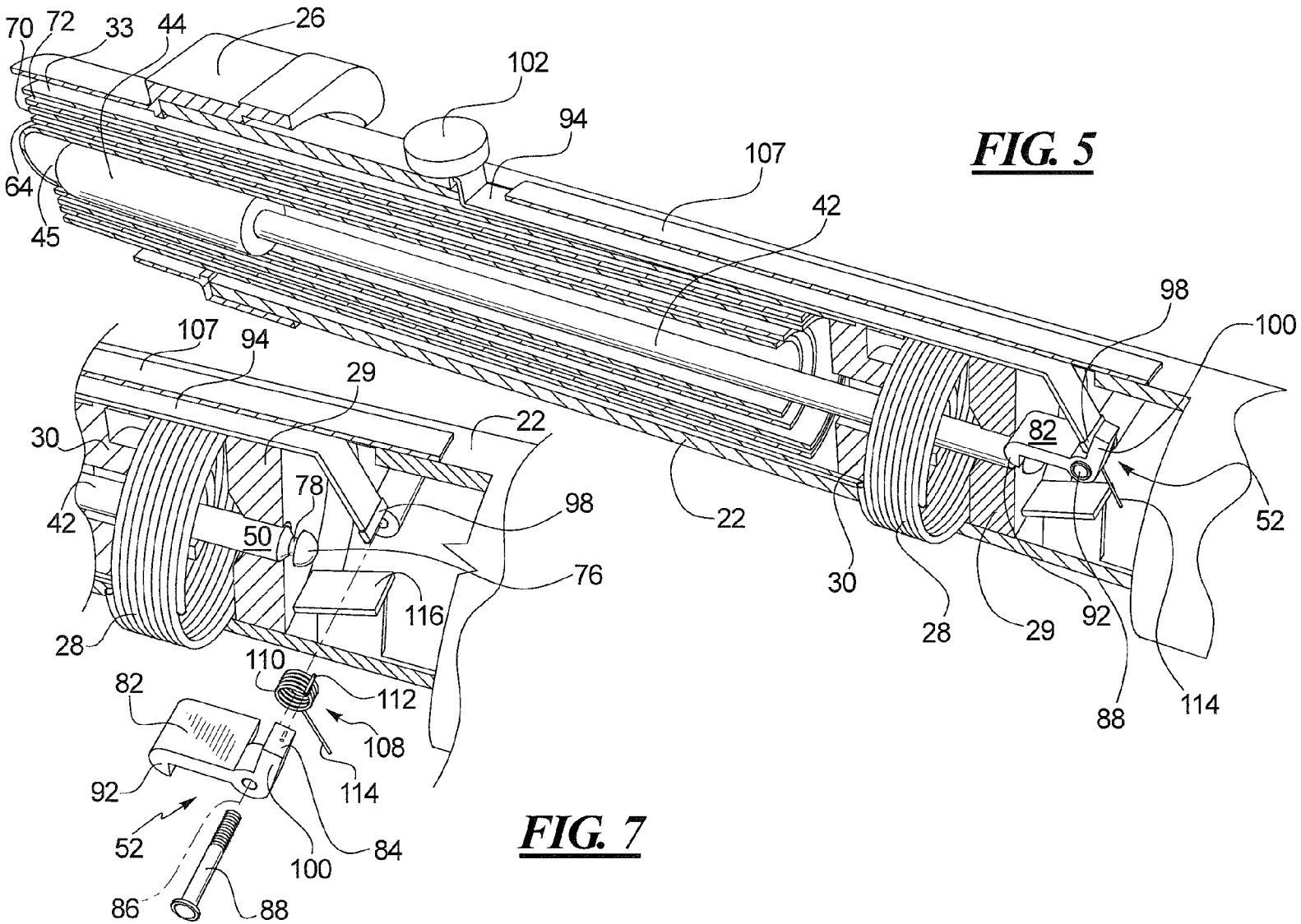
FIG. 5 is an enlarged sectional view of a latch and projectile constructed in accordance with the teachings of die disclosure and shown in a locked position.
FIG. 7 is an exploded view of the latch mechanism.
Figure 6:
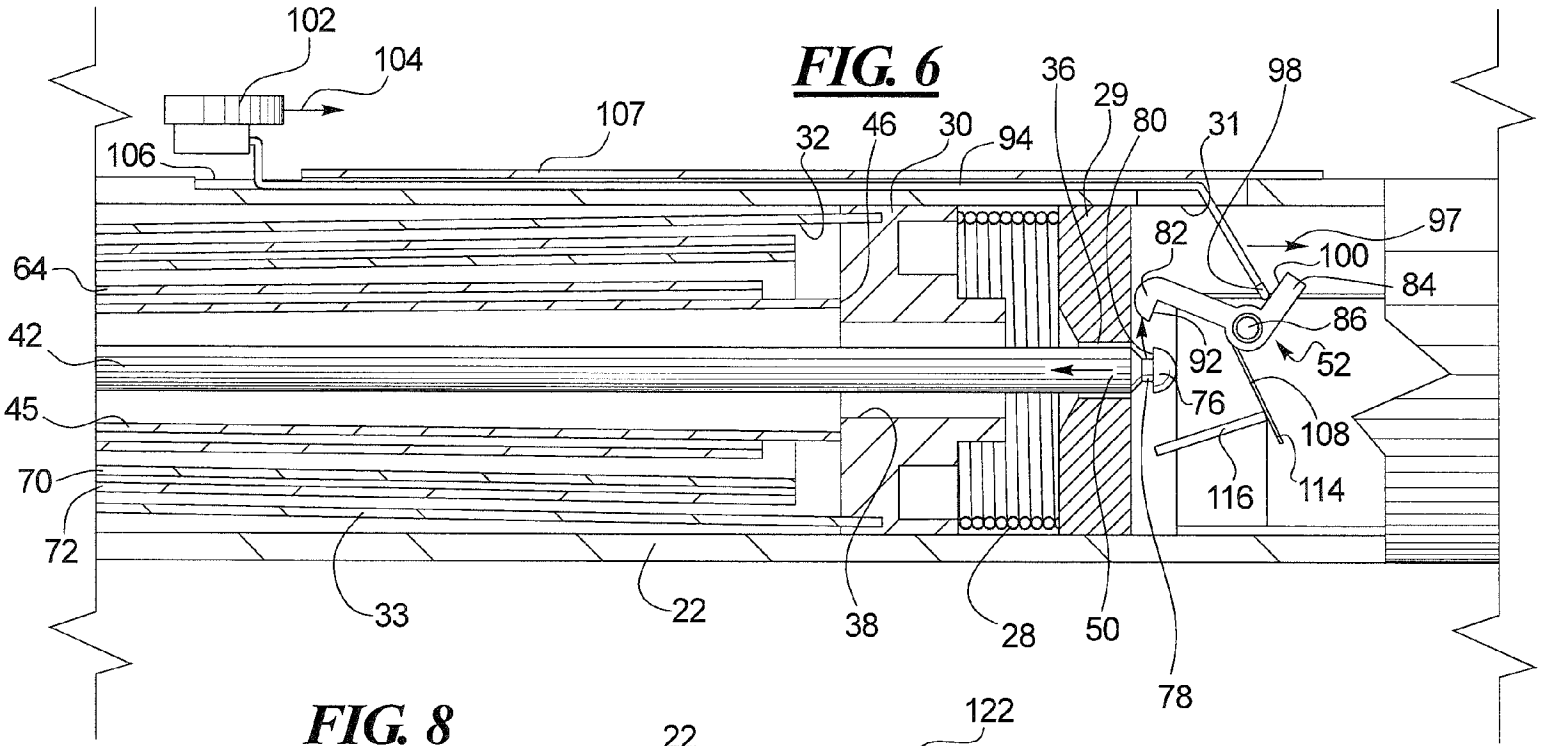
FIG. 6 is an enlarged sectional view of the latch and projectile shown in a released position.

Referring now to FIGS. 5 and 6, the manner in which the aforementioned latch 52 functions in combination with the projectile 40 will be described in further detail. As shown therein, the proximal end 50 of the stem 42 of projectile 40 is uniquely shaped. More specifically, the proximal end 50 includes a bulbous tail 76 forming a reduced diameter section 78 and a gripping ledge 80. In the retracted state, shown in FIGS. 4 and 5, the latch 50 engages the ledge 80 to hold the projectile 40 in a locked position. Only upon release of the latch 52 does the ledge 80 get released to thus allow for the spring 28 to launch the projectile 40 in the manner described above.

The latch 52 may be provided in any number of different forms, but in the depicted embodiment includes both a hook end 82 and a flange end 84. Between the hook end 82 and the flange end 84 is provided a pivot 86 where the latch 52 is mounted to the hilt 22 by way of a fastener 88 or the like. In the locked position of FIG. 5, it can be seen that the hook end 82 is substantially parallel to the longitudinal axis 90 of the toy 20 with the hook 92 itself physically engaging the ledge 80. In order to release the projectile 40, the hook 92 must be moved radially away from the ledge 80.

In order to do so, the flange end 84 may work in conjunction with a release bar 94. Specifically, the release bar 94 is moved parallel to the longitudinal axis 90 toward the proximal end 96 of the toy 20 in the direction of arrow 97. As the release bar 94 is so moved, its proximal end 98 engages the flange 100 of the flange end 84 and causes the latch 52 to pivot about fastener 88. As the latch 52 so pivots, the hook end 82 moves radially away from the ledge 80 thus releasing the projectile 40 and causing the plurality of telescoping tubes 24 to launch distally away from the hilt 22 in a manner described above.

Movement of the release bar 94 can be accomplished by way of an actuation button 102 provided on an outside surface of the hilt 22 for easy engagement by the child. Depression of the actuation button 102 in the direction indicated by reference numeral 104 causes the proximal end 98 of the release bar 94 to engage the flange 100 and thus cause the latch 52 to pivot. The facilitate such movement, a mounting groove 106 can be provided in the hilt 22 for movement of the release bar 94, and the proximal end 98 can be coated with material having a relatively low coefficient of friction so as to facilitate sliding movement of the proximal end 98 across the flange 100. A guard 107 may be mounted over the groove 106 to hold the release bar 94 in the hilt 22. Of course, other actuation structures can be provided including, but not limited to, inwardly depressible buttons, rocker switches, electronic actuators, pull tabs, rotating knobs, and the like.

In order to bias the latch 52 toward the locked position of FIG. 5, a spring 108 can be employed. As shown best in FIG. 7, the spring 108 may include a coil 110 from which extend arms 112 and 114. The arm 112 can be provided with the flange 100, while the arm 114 may extend toward a block 116 fixed in position with the hilt 22. Accordingly, as the actuation button 102 is depressed by the user, the release bar 94 slides against not only the flange 100, but the force of the spring 108 as well. Such movement causes the arm 112 to move, but as the arm 114 is prevented movement due to the block 116, rotational energy is stored in the coil 110. Once the user lets go of the actuation button 102, that energy is released and the aim 112 returns to its natural state. This movement causes the release bar 94 and actuation button 102 to slide upwardly and the latch 52 to pivot back into the locked position.

Figure 8:
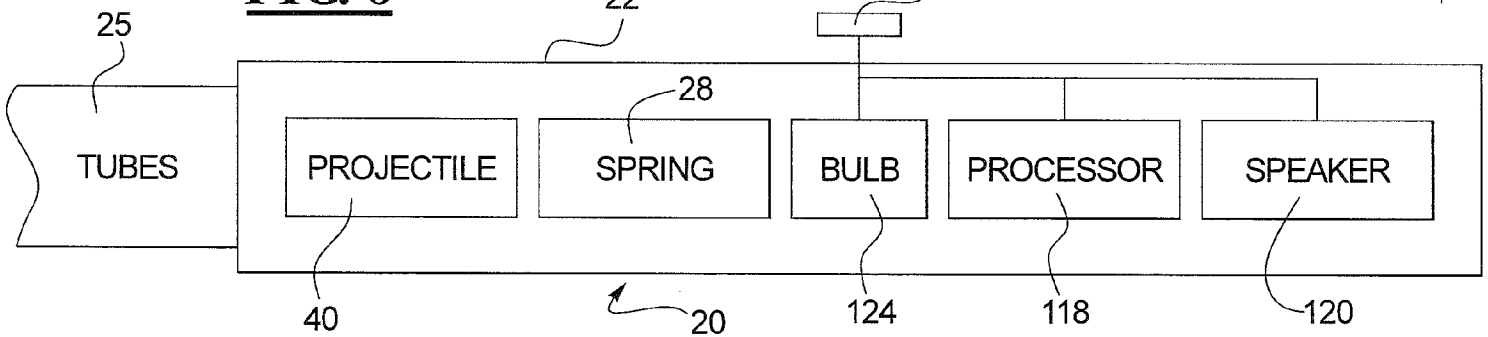
FIG. 8 is a schematic representation of the toy sword including its electronics.

Finally with reference to FIG. 8, the toy 20, including its possible electronics are shown in schematic fashion. While the foregoing description was made primarily with reference to the mechanical properties of the plurality of telescoping tubes 24 and the structure provided to enable such movement, the toy 20 can also be provided with audio and visual features to further enhance the enjoyment of the toy. Particularly, a processor 118 can be provided so as to coordinate generation of sounds and lights as the toy is used. For example, a speaker 120 can be provided along with an actuation device 122 so as to generate a sound replicating that used in the movies as the sword 20 is moved back and forth or swung. In addition, as the toy sword 20 is primarily based on the light sabers used within the Star Wars® series of movies, it is generally intended to replicate a light saber. Accordingly, electronics could be provided to not only generate the light, but also generate the light only upon movement of the plurality of tubes 24 is the distal direction. Once the telescoping tubes are retracted, the light would extinguish. A light bulb 124 could be provided in the hilt 22, the launching plate 30, or the largest diameter tube 33 for this purpose, while the plurality of telescoping tubes 24 could be manufactured from a translucent material, such as a polymer, to make the entire blade 25 appear lit. The light bulb 124 could be a conventional incandescent bulb, LED, or the like. In addition, electronics could be provided to allow for color changes depending upon the direction of movement, velocity at which it is moved, or in another planned or random fashion. The speaker 120, actuation device 122, and light bulb 124 could be provided anywhere within or on the hilt 22 and thus are only depicted in schematic fashion in FIG. 8.

From the foregoing, it can be seen that the teachings of the disclosure can be used to manufacture a toy sword or light saber 20 for enjoyment by children. As opposed to previous light sabers, the toy sword disclosed herein allows for the telescoping tubes 24 to be fully retracted into the hilt 22, thus more accurately replicating the actual swords used in the Star Wars® movies. In addition, the latch 52 disclosed herein enables the plurality of tubes 24 to be quickly and accurately launched to again more accurately depict the manner in which light sabers are cinematically energized. Moreover, by manufacturing the telescoping tubes 24 from a translucent material such as a translucent polymer or the like, and using an internal light source within the toy sword 20, the plurality of telescoping tubes 24 can more accurately depict an actual light saber from the Star Wars® series of movies.

What is claimed is:

1. A toy sword comprising:

a hilt;

a plurality of telescoping tubes mounted to the hilt, the plurality of telescoping tubes being movable between active and stowed positions, each of the plurality of telescoping tubes being substantially retracted into the hilt when in the retracted position, each of the plurality of telescoping tubes being extended from the hilt when in the active position;

a spring mounted only in the hilt and adapted to move the plurality of telescoping tubes from the stowed position to the active position when released from a compressed state; and a projectile, the plurality of telescoping tubes having a smallest diameter tube, the projectile being launched with the smallest diameter tube when the spring is released, the projectile and smallest diameter tube carrying the plurality of tubes to the active position.

2. The toy sword of claim 1, wherein the smallest diameter tube includes a closed end, the closed end holding the projectile when the plurality of tubes are in both the active and stowed positions.

3. The toy sword of claim 1, further including a latch holding the projectile, spring, a telescoping tubes in the stowed position.

4. The toy sword of claim 3, wherein the projectile includes a head and depending shaft, the depending shaft terminating in a shoulder, the latch having a hook adapted to engage the shoulder when the plurality of tubes are in the stowed position.

5. The toy sword of claim 4, wherein the latch further includes a flange at an end opposite to the hook, the latch being pivotably mounted in the hilt between the flange and the hook.

6. The toy sword of claim 5, further including a release bar, the release bar being slidably mounted in the hilt and engageable with the latch flange to pivot the latch.

7. The toy sword of claim 1, wherein the plurality of telescoping tubes are each translucent and a light is mounted in the hilt.

8. The toy sword of claim 1, further including audio and visual electronics.

9. A toy sword, comprising:

a hilt;

a plurality of telescoping tubes mounted to the hilt, the plurality of telescoping tubes movable between stowed and active positions; and a spring provided entirely within the hilt with no springs being provided within the plurality of telescoping tubes, the spring being movable between a compressed state wherein the plurality of telescoping tubes are in the stowed position, and a released state wherein the plurality of tubes are in the active position.

10. The toy sword of claim 9, further including a projectile, the plurality of telescoping tubes having a smallest diameter tube, the projectile being launched with the smallest diameter tube when the spring moves from the compressed state to the released state.

11. The toy sword of claim 10, wherein the smallest diameter tube includes a closed end, the closed end receiving the projectile when the plurality of tubes are in both the active and stowed positions.

12. The toy sword of claim 11, wherein the projectile includes a head and a depending shaft, and the plurality of telescoping tubes includes a largest diameter tube, a proximal end of the largest diameter tube being closed by a plate having an aperture, the depending shaft extending through the aperture, and the head engaging the plate when the plurality of telescoping tubes are in the stowed position.

13. The toy sword of claim 12, further including a releasable latch holding the plurality of telescoping tubes in the stowed position.

14. The toy sword of claim 13, wherein the depending shaft terminates in a bulb forming a shoulder, the latch including a hook engaging the shoulder.

15. The toy sword of claim 14, wherein the latch further includes a flange at an end opposite to the hook, the latch being pivotally mounted to the hilt between the flange and the hook.

16. The toy sword of claim 15, further including a release bar slidably mounted in the hilt and engaging with the latch flange.

17. A toy sword, comprising:

a hilt;

a plurality of telescoping tubes mounted to the hilt, the plurality of telescoping tubes being movable between stowed and active positions;

a spring movable between compressed and released positions, the spring launching the plurality of telescoping tubes from the stowed to the active position when released from the compressed state to the released state;

a latch releasably holding the spring in the compressed state, the latch including a hook end and a latch end and being pivotally mounted to the hilt between the hook end and the latch end; and a projectile including a head and a shoulder, the head engaging the plurality of telescoping tubes against the spring in the compressed state, the hook end of the latch engaging the projectile shoulder when the spring is in the compressed state.

18. The toy sword of claim 17, further including a release bar slidably mounted to the hilt, the release bar engaging the latch flange and pivoting the latch when a release button attached to the released bar is moved.

19. A toy sword, comprising:

a hilt;

a plurality of telescoping tubes mounted to the hilt, the plurality of telescoping tubes being movable between stowed and active positions;

a spring provided entirely within the hilt and remaining in the hilt regardless of the position of the tubes, the spring being adapted to move the telescoping tubes from the stowed position to the active position; and a projectile, the plurality of telescoping tubes having a smallest diameter tube, the projectile being launched with the smallest diameter tube when the spring is released, the projectile and smallest diameter tube carrying the plurality of tubes to the active position.

20. A toy sword, comprising:

a hilt;

a plurality of telescoping tubes mounted to the hilt, the plurality of telescoping tubes being movable between stowed and active positions;

a spring provided entirely within the hilt and remaining in the hilt when the plurality of telescoping tubes are in the stowed position as well as when the plurality of telescoping tubes are in the active position; and a projectile, the plurality of telescoping tubes having a smallest diameter tube, the projectile being launched with the smallest diameter tube when the spring is released, the projectile and smallest diameter tube carrying the plurality of tubes to the active position.

* * * * *